US009030128B2

(12) United States Patent
Wu

(10) Patent No.: US 9,030,128 B2
(45) Date of Patent: May 12, 2015

(54) LED DRIVE CIRCUIT

(71) Applicant: Lextar Electronics Corporation, Hsinchu (TW)

(72) Inventor: En-Min Wu, Taipei (TW)

(73) Assignee: Lextar Electronics Corporation, Hsinchu (TW)

( * ) Notice: Subject to any disclaimer, the term of this patent is extended or adjusted under 35 U.S.C. 154(b) by 0 days.

(21) Appl. No.: 14/077,261

(22) Filed: Nov. 12, 2013

(65) Prior Publication Data

US 2014/0306616 A1 Oct. 16, 2014

(30) Foreign Application Priority Data

Apr. 11, 2013 (TW) ..... 102112882 U

(51) Int. Cl.
*H05B 37/02* (2006.01)
*H05B 33/08* (2006.01)

(52) U.S. Cl.
CPC ..... *H05B 33/0815* (2013.01)

(58) Field of Classification Search
USPC ..... 315/186, 224, 226, 291, 297, 307, 308
See application file for complete search history.

(56) References Cited

U.S. PATENT DOCUMENTS 8,773,047 B2 7/2014 Chen
2009/0237007 A1* 9/2009 Leng ..... 315/297
2010/0295470 A1* 11/2010 Koutensky ..... 315/294
2011/0080110 A1* 4/2011 Nuhfer et al. ..... 315/291
2012/0248998 A1* 10/2012 Yoshinaga ..... 315/193
2012/0314456 A1* 12/2012 Lanni ..... 363/21.02

FOREIGN PATENT DOCUMENTS

CN 103023329 A 4/2013
TW 201228478 A 7/2012

OTHER PUBLICATIONS

TW Office Action dated Feb. 25, 2015 in corresponding Taiwan application (No. 102112882).

* cited by examiner

*Primary Examiner* — Tung X Le
(74) *Attorney, Agent, or Firm* — McClure, Qualey & Rodack, LLP

(57) ABSTRACT

An LED drive circuit applied between an LED load and an AC power supply is provided. The circuit includes a rectifier, a power conversion module, a voltage regulator, a photo coupler and a controller. The rectifier rectifies and converts an AC voltage outputted from the AC power supply into a DC voltage. The power conversion module converts the DC voltage into a first drive voltage and a second drive voltage. The first drive voltage drives the LED load. The voltage regulator receives and processes the second drive voltage with a voltage regulating process to generate a third drive voltage not exceeding a maximum voltage rating of the controller. The photo coupler generates a feedback signal according to a signal outputted from the LED load. The controller receives the third drive voltage and generates a control signal to control the power conversion module according to the feedback signal.

10 Claims, 2 Drawing Sheets

LED DRIVE CIRCUIT

This application claims the benefit of Taiwan application Serial No. 102112882, filed Apr. 11, 2013, the subject matter of which is incorporated herein by reference.

BACKGROUND OF THE INVENTION

1. Field of the Invention

The invention relates in general to a light emitting diode (LED) drive circuit, and more particularly to an LED drive circuit whose outputted drive voltage has a wider voltage range in the LED load by using the voltage regulating technology.

2. Description of the Related Art

Light emitting diode (LED) relates to a solid state light emitting element, which is formed by a semiconductor material and has the advantages of small size, low heat generation, high illumination, low power consumption, long lifespan and being applicable to mass production. Currently, most illuminating devices or backlight modules have used LED as light emitting source. As the application field of LED gets wider and wider, how to increase light emitting efficiency or reduce production cost to reduce the price has become a prominent task for the industries.

The switching power supply is the main design of drive circuit in the AC-to-DC power supply of the conventional LED illuminating device. The switching power supply uses a semiconductor unit as a switching element and controls the on/off duty cycle of the semiconductor unit by using the pulse width modulation (PWM) technology, such that the output of power supply can be stabilized.

According to different needs in practical application, the switching power supply is mainly divided into two types, namely, the isolated type drive circuit and the non-isolated type drive circuit. In the isolated circuit, there is no physical circuit connection between an input end of power supply and an output end of LED element, and a transformer outputs a voltage to provide necessary power for operation by way of electromagnetic induction. That is, the above two ends, which are the input and output ends, are electrically isolated from each other. In the non-isolated circuit, the two ends are connected by a physical circuit and are not electrically isolated from each other. Currently, the isolated circuit has various types such as flyback type, forward type, push-pull type, half bridge type, and full bridge type.

Ordinary single-stage flyback drive circuits with small to medium power, advantageously having simple structure, low manufacturing cost, isolated design conformed to safety standards, and compensation function in power factor correction (PFC), are conformed to the International Energy Efficiency Standards. The said drive circuit controls the stability in power output by using the PWM technology. However, the output voltage at the output end of the drive circuit used in the LED element is restricted by the range of working voltage of the semiconductor unit (that is, PWM controller or control integrated circuit), and cannot be used in the LED element requiring a larger range of output voltage.

To put it in greater details, under current technologies, the transformer can define a primary winding and a secondary winding at an input end of a power supply and an output end of an LED element respectively. The transform of DC voltage at the two ends is designed according to a fixed weight ratio, such as 1:2. When the voltage at one end is 10V, the voltage outputted to the other end is 20V. The PWM controller is located on the primary side of the transformer. Therefore, when the LED element needs a higher output voltage (for example, when the number of LED elements in series is increased), the voltage of the PWM controller will increase accordingly.

Given that the PWM controller is subjected to the restriction of a maximum voltage rating, when the voltage outputted to the PWM controller is higher than the maximum voltage rating, the PWM controller will stop controlling the output of the PWM signal, hence resulting in control errors or abnormal operations. For the LED element to receive a corresponding and appropriate output voltage, the transformer of the drive circuit needs to collaborate with different situations of practical application. For instance, the transformer with corresponding weight ratio is adopted in response to different numbers of LED elements in series. Under such circumstances, manufacturing and management will become more inconvenient, and production cost will increase accordingly.

SUMMARY OF THE INVENTION

The invention is directed to a light emitting diode (LED) drive circuit. By using the voltage regulating technology, the drive voltage outputted from the LED drive circuit has a wider voltage range in the LED load. Therefore, one single LED drive circuit of the present invention can collaborate with a variety of LED loads requiring different working voltages, not only increasing convenience in manufacturing and management but also effectively reducing production cost.

According to one embodiment of the present invention, an LED drive circuit applied between an LED load and an AC power supply is provided. The LED drive circuit comprises a rectifier, a power conversion module, a voltage regulator, a photo coupler and a controller. The rectifier rectifies and converts an AC voltage outputted from the AC power supply into a DC voltage. The power conversion module is electrically connected to the rectifier and the LED load for converting and outputting the DC voltage into a first drive voltage and a second drive voltage. The first drive voltage is used to drive the LED load to provide necessary power for operation. The voltage regulator is electrically connected to the power conversion module for receiving and processing the second drive voltage with a voltage regulating process to generate a third drive voltage. The photo coupler is electrically connected to connected to an input end of the LED load for generating a feedback signal according to an output signal outputted from the input end. The controller is electrically connected to the voltage regulator and the photo coupler for receiving the third drive voltage and generating a control signal according to the feedback signal. The control signal controls the power conversion module by using the pulse width modulation (PWM) technology. The voltage regulator controls the third drive voltage not to exceed a maximum voltage rating of the controller.

Based on the above concepts, the power conversion module comprises a DC-to-DC conversion unit, a first filter, and a second filter. The DC-to-DC conversion unit is electrically connected to the rectifier for converting the DC voltage into a first DC voltage and a second DC voltage. The first filter is electrically connected between the DC-to-DC conversion unit and the LED load for filtering the first DC voltage to generate a first drive voltage. The second filter is electrically connected between the DC-to-DC conversion unit and the voltage regulator for filtering the second DC voltage to generate a second drive voltage.

Based on the above concepts, the controller is electrically connected to the DC-to-DC conversion unit for controlling the magnitudes of the first and the second DC voltages outputted from the DC-to-DC conversion unit by using the PWM technology.

Based on the above concepts, the first and the second drive voltages form a positively proportional relationship, and the first drive voltage generates corresponding changes according to an operating load of the LED load.

The above and other aspects of the invention will become better understood with regard to the following detailed description of the preferred but non-limiting embodiment(s). The following description is made with reference to the accompanying drawings.

DETAILED DESCRIPTION OF THE INVENTION

Figure 1:
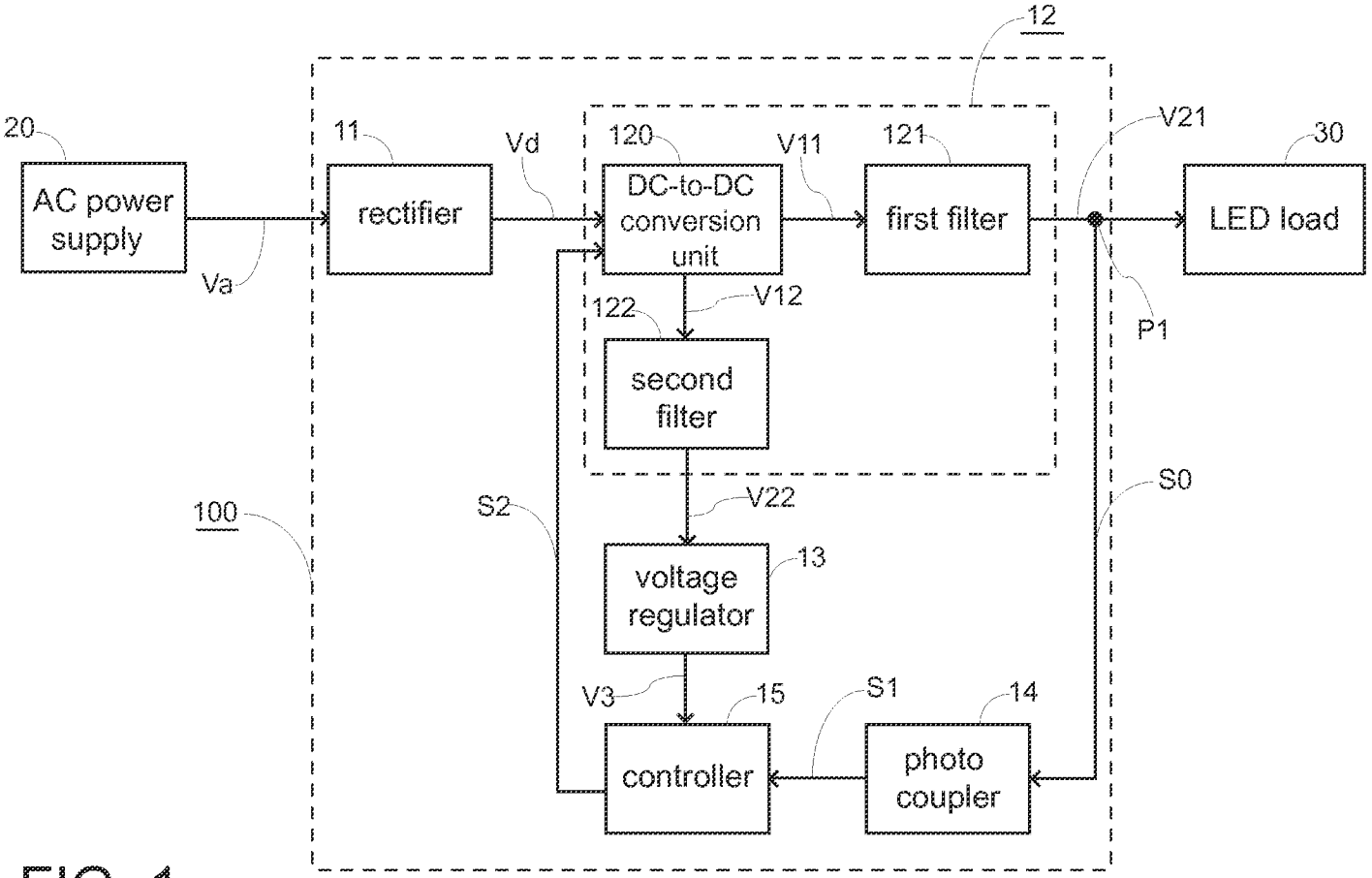
FIG. 1 is a functional block diagram of an LED drive circuit 100 according to the present invention.

An implementation of the present invention is exemplified by an exemplary embodiment. Referring to FIG. 1, a functional block diagram of an LED drive circuit 100 according to the present invention is shown. As indicated in FIG. 1, the LED drive circuit 100 is applied between an LED load 30 and an AC power supply 20. The AC power supply 20 outputs an AC voltage Va to provide necessary power for operation. The LED load 30 relates to a plurality of LED elements. Every particular number of LED elements is connected in connected in series. In practical manufacturing, the LED load 30 and the LED drive circuit 100 of the present invention are combined as an LED illuminating device.

Figure 2:
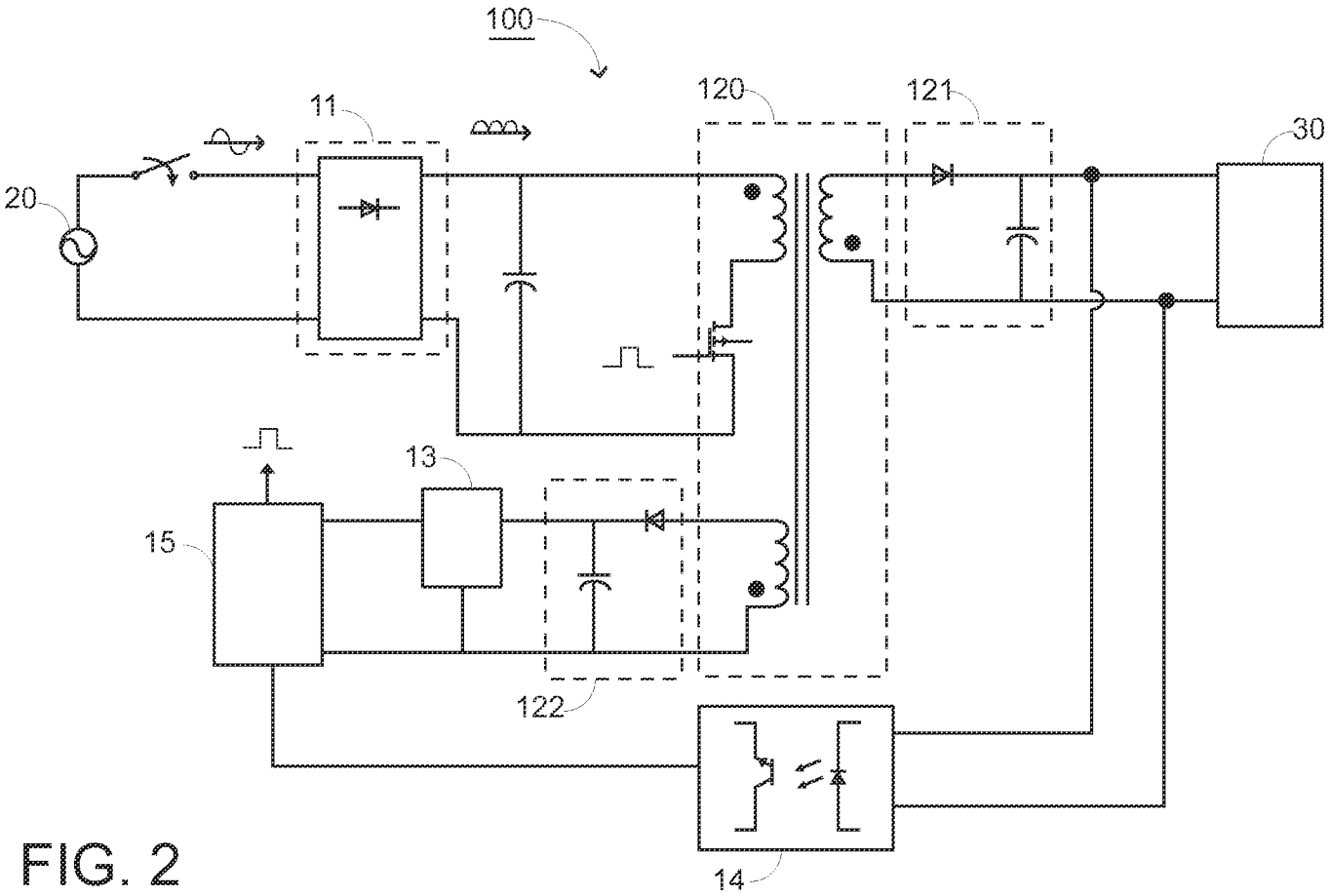
FIG. 2 is a detailed circuit diagram of the LED drive circuit 100 in practical application according to the present invention.

As indicated in FIG. 1, the LED drive circuit 100 comprises a rectifier 11, a power conversion module 12, a voltage regulator 13, a photo coupler 14 and a controller 15. FIG. 1 further illustrates the relationships of electrical connection between elements. The rectifier 11 rectifies and converts the AC voltage Va outputted from the AC power supply 20 into a DC voltage Vd. The power conversion module 12 is electrically connected with the rectifier 11, the LED load 30 and the voltage regulator 13 for converting and outputting the DC voltage Vd into a first drive voltage V21 and a second drive voltage V22 respectively. The first drive voltage V21 is an output voltage used to drive the LED load 30 to provide necessary power for operation. The second drive voltage V22 is correspondingly outputted to the voltage regulator 13, It can be known from the above disclosure that the LED drive circuit 100 applied in the AC power supply 20 is a switching power supply. The LED drive circuit 100 uses the PWM technology to stabilize the output of the power supply. Furthermore, the power conversion module 12 comprises a DC-to-DC conversion unit 120, a first filter 121 and a second filter 122. The DC-to-DC conversion unit 120 is electrically connected to the rectifier 11. The first filter 121 is electrically connected between the DC-to-DC conversion unit 120 and the LED load 30. The second filter 122 is electrically connected between the DC-to-DC conversion unit 120 and the voltage regulator 13. In practical application, the circuit design of the LED drive circuit 100 of the present invention is like the circuit diagram illustrated in FIG. 2.

In the present embodiment, the DC-to-DC conversion unit 120 relates to a circuit structure of a flyback converter, that is, an isolated circuit using an electromagnetic induction type transformer to output a DC voltage. It can be known from the prior art that the circuit structure of the flyback converter respectively defines a primary winding and a secondary winding with respect to the output transform of the transformer. There is a fixed weight ratio between the transform of DC voltage at the two sides. In the present embodiment, the DC-to-DC conversion unit 120 converts the DC voltage Vd into a first DC voltage V11 and a second DC voltage V12 respectively and further outputs the first DC voltage V11 and the second DC voltage V12. The first DC voltage V11 is outputted from the secondary side of the circuit structure of the flyback converter. The second DC voltage V12 is outputted from the primary side of the circuit structure of the flyback converter.

As indicated in FIG. 1, the first filter 121 and the second filter 122 further process corresponding DC voltage, and filter the first DC voltage V11 and the second DC voltage V12 to generate the first drive voltage V21 and the second drive voltage V22 respectively. That is, the voltages driving the LED load 30 and the voltage regulator 13 respectively can be outputted according to more stable conditions It can be know from the prior art that apart from the relationship between the first DC voltage V11 and the second DC voltage V12, a positively proportional relationship between the first drive voltage V21 and the second drive voltage V22 is formed following a filtering process. For instance, as the load of the LED load 30 becomes larger (for example, when the number of LED elements in series is increased), the first drive voltage V21 will increase accordingly; as the load of the LED load 30 becomes smaller (for example, when the number of LED elements in series is reduced), the first drive voltage V21 will decrease accordingly. That is, the magnitude of the first drive voltage V21 varies with the operating load of the LED load 30. The second drive voltage V22 at the primary side is positively proportional to the first drive voltage V21 (that is, the second drive voltage V22 is related to the corresponding weight ratio and number of windings of the transformer), and will increase or decrease accordingly.

According to one feature of the present invention, the voltage regulator 13 can receive a wider range of drive voltage. The second drive voltage V22, being positively proportional to the first drive voltage V21, may generate as the first drive voltage V21 varies. When the voltage regulator 13 of the present invention receives the second drive voltage V22 and is driven thereby, the voltage regulator 13 performs a voltage regulating process on the second drive voltage V22 to correspondingly generate a third drive voltage V3. The controller 15 electrically connected to the voltage regulator 13 is driven by the third drive voltage V3 to perform associated control operations.

Besides, the photo coupler 14 electrically connected between the controller 15 and an input end P1 of the LED load 30 generates a feedback signal S1 to the controller 15 according to an output signal S0 outputted from the input end P1. In the present embodiment, the output signal S0 is associated with the LED load 30 driven by the power conversion module 12. To put it in greater details, the output signal S0 is generated by the LED load 30, and the content of the output signal S0 is the first drive voltage V21 and the current corresponding to the first drive voltage V21 or only the current corresponding to the input end P1. Or, the content of the output signal S0 is a ratio of the first drive voltage V21 to the current or the voltage flowing through the LED load 30.

In the present embodiment, the controller 15 generates a control signal S2 to control the operation of the power conversion module 12 according to the calculation results of the content of the feedback signal S1. To put it in greater details, the control signal S2 outputted from the controller 15 controls the operation of the power conversion module 12 by using the pulse width modulation (PWM) technology. That is, the control signal S2 controls the magnitudes of the first DC voltage V11 and the second DC voltage V12 outputted from the DC-to-DC conversion unit 120. Under the control of the controller 15, the DC-to-DC conversion unit 120 will be charged when the DC-to-DC conversion unit 120 is turned on and will be discharged when the DC-to-DC conversion unit 120 is turned off.

According to another feature of the present invention, the third drive voltage V3 generated by the voltage regulator 13 does not vary with the second drive voltage V22 which is positively proportional to the first drive voltage V21. In terms of practical operation, the third drive voltage V3 can be more stably controlled at a particular rating. In the present embodiment, the voltage regulator 13 comprises a voltage stabilizing integrated circuit or a passive element, such as a Zener diode, for implementing the voltage regulating technology of the invention.

In the present embodiment, the voltage regulator 13, through suitable design, can drive the controller 15 with a particular rating of voltage (that is, the third drive voltage V3). The crux lies in that a maximum voltage rating of the controller 15 must be taken into consideration in the design of a voltage regulating process of the voltage regulator 13. It can be known from the prior art that ordinary PWM controllers are subjected to the restriction of maximum voltage ratings. For a controller to operate normally, the voltage outputted to the controller must not exceed its maximum voltage rating. According to the design of the present invention, the voltage regulator 13 controls the third drive voltage V3 not to exceed (that is, less than or equal to) the maximum voltage rating of the controller 15.

Considering the LED load 30 may have different loads in practical applications (such as when the number of LED elements in series is changed), the second drive voltage V22 may vary accordingly and may be less than, equal to or greater than the maximum voltage rating of the controller 15. According to the design of the present embodiment, when the second drive voltage V22 is less than (or equal to) the maximum voltage rating, the voltage regulator 13 does not perform the voltage regulating process. Instead, the voltage regulator 13 directly uses the second drive voltage V22 to drive the controller 15. Thus, the controller 15 can operate normally, and such effect is similar to the prior art.

When the second drive voltage V22 is greater than the maximum voltage rating, the voltage regulator 13 performs the voltage regulating process on the second drive voltage V22 to generate the third drive voltage V3 to drive the controller 15. That is, the third drive voltages V3 generated from the voltage regulating process will be less than the second drive voltage V22. Or, in terms of the result of the voltage regulating process, the maximum of the third drive voltages V3 generated from the voltage regulating process is the maximum voltage rating. For instance, when the maximum voltage rating is 12V, the third drive voltage V3 can be designed to be less than or equal to 12V, such that the controller 15 still can operate normally even when the second drive voltage V22 is greater than 12V.

Generally speaking, the maximum voltage rating of the controller 15 is normally a voltage range, not a particular voltage rating. In this regard, the third drive voltage V3 generated from the voltage regulating process can be designed as a median of the range of maximum voltage ratings of the controller 15. For instance, when the maximum voltage rating ranges between 10~15V, the third drive voltage V3 generated from the voltage regulating process can be designed as 12.5V, such that the controller 15 still can operate normally even when the second drive voltage V22 is greater than 15V. In short, the rating of the third drive voltage V3 generated by the voltage regulator 13 is subjected to the operation conditions of the controller 15.

Given that the voltages generated and used to drive the controller 15 do not exceed the maximum voltage rating of the controller 15, the LED drive circuit 100 has a wider range of voltages correspondingly outputted in response to different loads of the LED load 30. That is, based on the concept of the present invention, the LED drive circuit 100 can collaborate effectively and operate normally with the LED load 30 no matter the number of LED elements in series is small or large. The smaller the number of LED elements in series, the shorter the LED lamp; the larger the number of LED elements in series, the longer the LED lamp.

It can be known from the prior art that the transformer of an ordinary drive circuit needs to have different design (with different numbers of windings) to collaborate with the LED elements and provide corresponding output voltage. Since the LED drive circuit 100 of the present invention has a wider range of output voltage in response to different loads of the LED load 30, the design of the DC-to-DC conversion unit 120 is based on different weight ratios of numbers of windings. As long as the voltage regulator 13 has appropriate voltage regulating function, one single LED drive circuit 100 can collaborate and assembly with a variety of LED loads 30 requiring different working voltages. That is, the technology of the present invention provides convenience in manufacturing and management and at the same time effectively reduces production cost.

In an exemplary embodiment of the present invention, the power conversion module 12 is composed of a first filter 121 and a second filter 122. Given that equivalent filtering effect can be achieved, the said filters can be replaced by other related capacitors or circuit structures. Similarly, in the exemplary embodiment of the present invention, the voltage regulator 13 is composed of a voltage stabilizing integrated circuit or a passive element such as a Zener diode. Given that equivalent conditions of the voltage regulating technology can be provided, the voltage regulator 13 can be replaced by other related semiconductor elements or circuit structures.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A light emitting diode (LED) drive circuit applied between an LED load and an AC power supply, wherein the LED drive circuit comprises:

a rectifier used for rectifying and converting an alternate current (AC) voltage outputted from the AC power supply into a direct current (DC) voltage;

a power conversion module electrically connected to the rectifier and the LED load for converting and outputting the DC voltage into a first drive voltage and a second drive voltage, wherein the first drive voltage is used to drive the LED load to provide necessary power for operation;

a voltage regulator electrically connected to the power conversion module for receiving and processing the second drive voltage with a voltage regulating process to generate a third drive voltage;

a photo coupler electrically connected to an input end of the LED load for generating a feedback signal according to an output signal outputted from the input end; and a controller electrically connected to the voltage regulator and the photo coupler for receiving the third drive voltage and generating a control signal according to the feedback signal, wherein the control signal controls the power conversion module by using a pulse width modulation (PWM) technology;

wherein, the voltage regulator controls the third drive voltage not to exceed a maximum voltage rating of the controller.

2. The LED drive circuit according to claim 1, wherein the power conversion module comprises:

a DC-to-DC conversion unit electrically connected to the rectifier for converting the DC voltage into a first DC voltage and a second DC voltage;

a first filter electrically connected between the DC-to-DC conversion unit and the LED load for filtering the first DC voltage to generate the first drive voltage; and a second filter electrically connected between the DC-to-DC conversion unit and the voltage regulator for filtering the second DC voltage to generate the second drive voltage.

3. The LED drive circuit according to claim 2, wherein the controller is electrically connected to the DC-to-DC conversion unit for controlling the magnitudes of the first and the second DC voltages outputted from the DC-to-DC conversion unit by using the PWM technology.

4. The LED drive circuit according to claim 2, wherein the first and the second drive voltages form a positively proportional relationship.

5. The LED drive circuit according to claim 4, wherein the first drive voltage generates corresponding changes according to an operating load of the LED load.

6. The LED drive circuit according to claim 2, wherein the DC-to-DC conversion unit relates to a circuit structure of a flyback converter.

7. The LED drive circuit according to claim 6, wherein the first DC voltage is outputted from a secondary side of the circuit structure of the flyback converter, and the second DC voltage is outputted from a primary side of the circuit structure of the flyback converter.

8. The LED drive circuit according to claim 1, wherein the output signal is outputted according to a ratio of the first drive voltage to the voltage or the current flowing through the LED load.

9. The LED drive circuit according to claim 1, wherein the voltage regulator comprises a voltage stabilizing integrated circuit or a passive element.

10. The LED drive circuit according to claim 9, wherein the passive element relates to a Zener diode.

* * * * *